United States Patent [19]

Johnson

[11] Patent Number: 4,799,636

[45] Date of Patent: Jan. 24, 1989

[54] AUTOMATICALLY POSITIONED HOLDER FOR BABY BOTTLES

[76] Inventor: William M. Johnson, P.O. Box 70404, Eugene, Oreg. 97401

[21] Appl. No.: 91,381

[22] Filed: Aug. 31, 1987

[51] Int. Cl.[4] ..... A47D 15/00

[52] U.S. Cl. ..... 248/102; 248/105; 248/133

[58] Field of Search ..... 248/105, 106, 107, 102, 248/133, 137, 139, 143

[56] References Cited

U.S. PATENT DOCUMENTS

| | | | |
|---|---|---|---|
| 497,878 | 5/1893 | Higham | 248/143 |
| 1,249,341 | 12/1917 | Cropsey | 248/139 |
| 2,311,397 | 2/1943 | Kazimirow | 248/102 |
| 2,397,059 | 3/1946 | Swank | 248/105 |
| 2,489,773 | 11/1949 | Hall | 248/105 |
| 2,748,952 | 6/1956 | Fleit et al. | 211/74 |
| 3,112,837 | 12/1963 | Manoyian | 215/11 |
| 3,584,818 | 6/1971 | Essman | 248/105 |
| 3,648,958 | 3/1972 | Araujo | 248/105 |
| 3,905,571 | 9/1975 | Lombardo | 248/102 |

FOREIGN PATENT DOCUMENTS

| | | | |
|---|---|---|---|
| 637337 | 2/1962 | Canada | 248/102 |
| 271234 | 3/1914 | Fed. Rep. of Germany | 248/133 |
| 442691 | 4/1927 | Fed. Rep. of Germany | 248/143 |
| 1444873 | 8/1976 | United Kingdom | 248/105 |

*Primary Examiner*—Ramon S. Britts
*Assistant Examiner*—David J. Talbott
*Attorney, Agent, or Firm*—James D. Givnan, Jr.

[57] ABSTRACT

A baby bottle holder having an enclosure into which the bottle is inserted. A curved surface of the holder permits rocking of the holder upon the bottle being emptied. A weight in the holder imparts rocking movement to the holder upon termination of nursing effort by the infant. An internal wall of the holder insulates the bottle as well as defines air passageways to ease bottle insertion and removal.

6 Claims, 1 Drawing Sheet

AUTOMATICALLY POSITIONED HOLDER FOR BABY BOTTLES

BACKGROUND OF THE INVENTION

The present invention pertains generally to holders for baby bottles to support the bottle while the baby is nursing.

It is a common practice for a baby bottle to be positioned in an inclined manner to provide convenient access for the infant. The continued nursing effort by the infant, after emptying of the bottle, is believed to have an adverse effect on the infant in the opinion of some. Namely, after emptying of the bottle, teeth and jaw problems are believed to result from excessive nursing efforts. Further, opinion exists that the continued presence of small amounts of milk or formula in the infant's mouth over a long period of time can have an adverse effect on the teeth. Not uncommonly the bottle is propped adjacent the child to cause the nipple to remain in the child's mouth for long periods subsequent to completion of nursing as when the infant is asleep.

The supporting of a baby bottle to position same for convenient access by the infant is offtimes accomplished by resting of the bottle on a pillow or blanket in a more or less haphazard manner resulting in displacement of the bottle before the infant has emptied same. While others have attempted to provide bottle supports to position the bottle during nursing, the same, to the inventor's knowledge, have never been widely accepted for one reason or another. Examples of such prior art devices are found in the following patents; U.S. Pat. Nos. 932,344, 1,778,545, 3,405,829, 1,368,544, 2,412,426, and 2,989,278.

SUMMARY OF THE PRESENT INVENTION

The present invention is embodied within a bottle holder which positions the bottle away from the infant upon reduction of bottle weight.

The present holder includes a curved surface which permits the holder to rotate away from the infant and simultaneously raise the exposed end of the bottle to terminate nursing. The holder is weighted in an off center manner which imparts rotation to the holder to move same upwardly and away from the infant's mouth. One form of the invention embodies the present holder in a spherical shape having a bottle receiving opening which defines voids or air passageways through which air may pass during installation and removal of the baby bottle from the holder. The holder mounted weight may serve as a limit stop for bottle insertion to assure proper positioning of the bottle within the holder. A modified form of the holder includes a cylindrical housing having a weighted body at one end with an appendage extending downwardly from the housing and provided with a curved surface on which the bottle and holder may rotate.

Important objectives of the present holder include the provision of a baby bottle holder which automatically rotates upwardly away from the infant's mouth as the child terminates nursing; the provision of a bottle holder which substantially encloses the bottle to diminish heat loss therefrom; the provision of a bottle holder which facilitates bottle insertion and removal by providing air passageways for the outward and inward flow of air; the provision of a bottle holder equipped with a weighted member offset from the holder center which causes automatic repositioning of the holder and bottle upon termination of nursing to prevent spillage from a partially empty bottle.

DETAILED DESCRIPTION OF THE PREFERRED EMBODIMENTS

Figure 1:
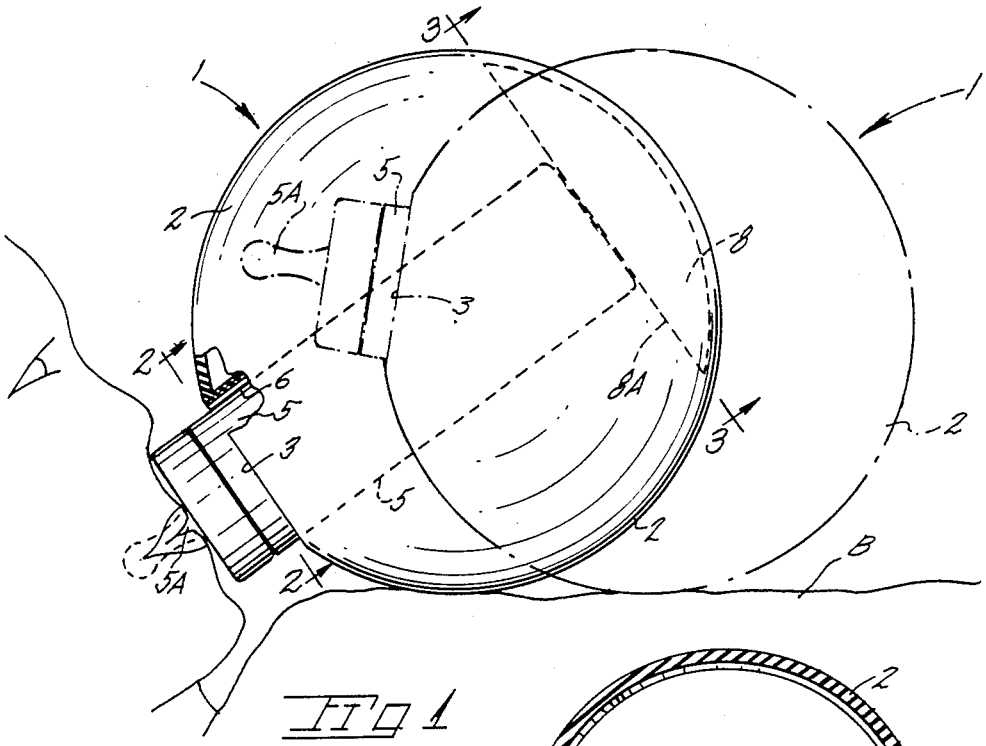
FIG. 1 is a side elevational view of the present holder operatively disposed.
Figure 2:
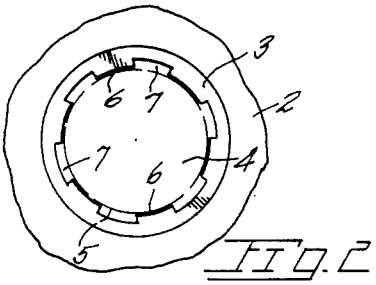
FIG. 2 is an elevational view taken along line 2—2 of FIG. 1.
Figure 3:
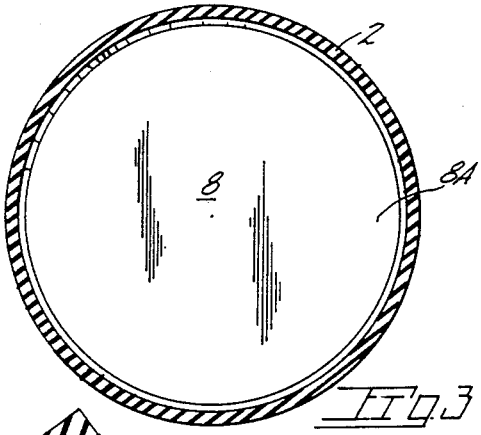
FIG. 3 is a sectional view taken along line 3—3 of FIG. 1 and disclosing the weighted member of the holder.

With continuing attention to the drawings wherein applied reference numerals indicate parts similarly hereinafter identified, the reference numeral 1 indicates generally a bottle holder enclosure of spherical shape. A baby blanket is at B.

The enclosure 1 has an outer wall 2 and a chordal wall 3 which defines an opening 4 for the inserted reception of a baby nursing bottle 5. An internal wall surface 6 provides bottle retention. Air passageways at 7 in internal wall surface 6 prevent air pressure extremes from occurring in the holder during bottle insertion and removal.

Disposed within the holder is a weight 8 sutiably fixed in place. Such a weight may be a separate body of high density material or a solid body of that material used for the enclosure 1. A surface 8A of the weight is at one end of opening 4 and serves to limit inward movement of the bottle 5.

Figure 4:
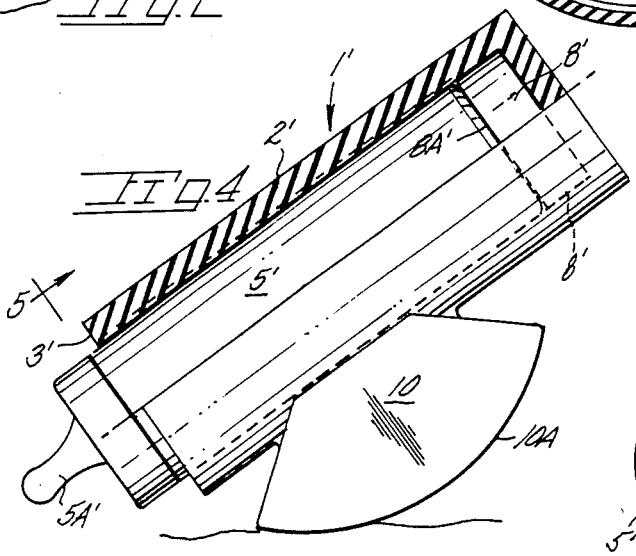
FIG. 4 is a side elevational view of a modified holder with a housing broken away along a housing center line.
Figure 5:
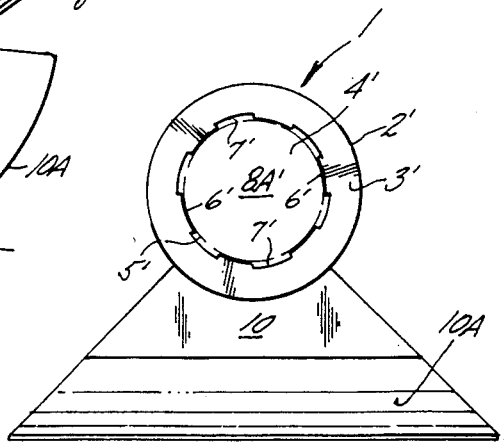
FIG. 5 is an end elevational view of the modified holder taken along line of FIG. 4.

As the baby bottle is emptied, weight 8 is effective to impart rotation to the enclosure to displace the bottle nipple 5A upwardly and away from the infant all of which occurs upon termination of the infant's nursing efforts In the modified form of the holder shown in FIGS. 4 and 5, the enclosure, generally at 1', is of elongate shape and is shown as being generally cylindrical. A pedestal 10 is integral with the enclosure outer wall 2' and includes a rounded surface 10A which supports the enclosure in a rockable manner. Pedestal 10 is of a width, as viewed in FIG. 5, to provide lateral stability to the holder. An end wall at 3' defines an opening 4' for insertion of a baby nursing bottle 5'. An internal wall 6' defines air passageways at 7' facilitate bottle insertion and removal.

A weight at 8' is carried within the closed end of the enclosure and includes a surface 8A'. For the sake of convenience, the weight 8' may be shaped to permit installation through bottle receiving opening 4'.

Both bottle holders may be formed with attractive material capable of withstanding repeated cleanings in automatic dishwashing machines. Further, the enclosures may be lightened by the aperturing or slotting of the walls 2 and 2'.

In use the infant has convenient access to the nursing bottle until such time as the bottle weight is reduced by consumption of the contents at which time upon release of the nipple the bottle holder will rotate causing upward removal of the nipple as well as displacement away from the infant per the broken line position of FIG. 1.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

1. A baby nursing bottle holder for use during the feeding of an infant and comprising in combination, a bottle enclosure having a generally curved surface on which the holder may rest during feeding, said enclosure having an internal wall surface defining a bottle receiving opening for lengthwise frictional engagement with the bottle when the bottle is inserted into said enclosure, and a weight of higher density material than said enclosure and housed in the enclosure and defining the end of the bottle receiving opening, said weight located in an offset manner from the center of gravity of the enclosure for imparting rotation to the enclosure and a baby bottle therein at the termination of infant feeding.

2. The bottle holder claimed in claim 1 wherein said enclosure is of spherical shape.

3. The bottle holder claimed in claim 1 wherein said enclosure is of elongate shape.

4. The bottle holder claimed in claim 2 wherein said curved surface is embodied within a portion of the enclosure exterior.

5. The bottle holder claimed in claim 3 wherein said enclosure additionally includes a pedestal, said curved surface on said pedestal.

6. The bottle holder claimed in claim 1 wherein said weight has a surface adapted for abutment with said bottle to serve as a limit stop during insertion of the bottle into the holder.

* * * * *